US009152127B2

(12) United States Patent
Kawasumi

(10) Patent No.: US 9,152,127 B2
(45) Date of Patent: Oct. 6, 2015

(54) IMAGE FORMING APPARATUS

(71) Applicant: CANON KABUSHIKI KAISHA, Tokyo (JP)

(72) Inventor: Ryoichi Kawasumi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/153,292

(22) Filed: Jan. 13, 2014

(65) Prior Publication Data

US 2014/0205309 A1 Jul. 24, 2014

(30) Foreign Application Priority Data

Jan. 23, 2013 (JP) ..... 2013-010476

(51) Int. Cl.
*G03G 21/20* (2006.01)

(52) U.S. Cl.
CPC ..... *G03G 21/206* (2013.01); *G03G 2221/1645* (2013.01)

(58) Field of Classification Search
CPC ..... G03G 21/206; G03G 21/20
USPC ..... 399/92
See application file for complete search history.

(56) References Cited

U.S. PATENT DOCUMENTS

| | | | | |
|---|---|---|---|---|
| 7,289,747 | B2 * | 10/2007 | Miyamoto et al. | 399/92 |
| 8,401,432 | B2 * | 3/2013 | Hayashi et al. | 399/253 |
| 2009/0123173 | A1 * | 5/2009 | Kadowaki | 399/92 |
| 2012/0308243 | A1 | 12/2012 | Kawasumi | |
| 2013/0058676 | A1 * | 3/2013 | Sato | 399/92 |

FOREIGN PATENT DOCUMENTS

| | | | | |
|---|---|---|---|---|
| JP | 2008-170853 | A | | 7/2008 |
| JP | 2008-268528 | A | | 11/2008 |
| JP | 2009103785 | A | * | 5/2009 |
| JP | 2009288583 | A | * | 12/2009 |
| JP | 5016930 | B2 | | 9/2012 |
| JP | 5137452 | B2 | | 2/2013 |

* cited by examiner

*Primary Examiner* — Clayton E Laballe
*Assistant Examiner* — Leon W Rhodes, Jr
(74) *Attorney, Agent, or Firm* — Fitzpatrick, Cella, Harper & Scinto

(57) ABSTRACT

An image forming apparatus includes a development device, an airflow generating device which generates an airflow, and a support member which supports a lower surface of the development device. An inner door is openable and closable so as to detachably attach the development device, an outer door covers the inner door, and a first duct portion is formed by the inner door and a lateral surface of the development device. The first duct portion guides the airflow along the lateral surface in a vertical direction, and a second duct portion guides the airflow along a longitudinal direction of the development device.

11 Claims, 11 Drawing Sheets

IMAGE FORMING APPARATUS

BACKGROUND OF THE INVENTION

1. Field of the Invention

The present invention relates to an image forming apparatus having a cooling mechanism which cools a developing unit.

2. Description of the Related Art

Japanese Patent Laid-Open No. 2008-170853 discloses that an imaging unit is disposed below an intermediate transfer belt and a writing unit is disposed below the imaging unit. Further, an airflow duct is formed between the imaging unit and the writing unit to pass cooling air. The cooling air is adapted to cool the imaging unit through a slit formed in the airflow duct.

In Japanese Patent Laid-Open No. 2008-170853, however, since airflow is formed to cool a bottom surface of the imaging unit from a short-side direction of the imaging unit, the slit is required for exposure to the airflow duct. Thus, there is a risk that a toner scattered from a development device through the slit contaminates an exposure unit or other members inside the apparatus body.

It is desirable to provide an image forming apparatus having a cooling mechanism capable of cooling a bottom of a developing unit while suppressing the contamination of the inside of the apparatus body due to scattering of a developer.

SUMMARY OF THE INVENTION

An image forming apparatus includes: a development device which is provided so as to be detachably attachable to an apparatus body to develop an electrostatic image on a surface of an image bearing member with a developer; an airflow generating device which generates an airflow; a duct which induces the airflow generated by the airflow generating device into the apparatus body; and a support member which supports a lower surface of the development device along a longitudinal direction of the development device; wherein a tubular flow path is formed between the support member and a bottom of the development device such that air flows along the longitudinal direction, and the flow path is connected to the duct.

Further features of the present invention will become apparent from the following description of exemplary embodiments with reference to the attached drawings.

DESCRIPTION OF THE EMBODIMENTS

Hereinafter, an exemplary embodiment of the invention will be illustratively described in detail with reference to the accompanying drawings. However, the dimensions, materials, shapes, and relative arrangements of the components that are described in this embodiment are appropriately modified according to a configuration of an apparatus to which the invention is applied, and various conditions, therefore, unless otherwise specifically described, the embodiment is not intended to limit the scope of the invention only thereto.

Figure 1:
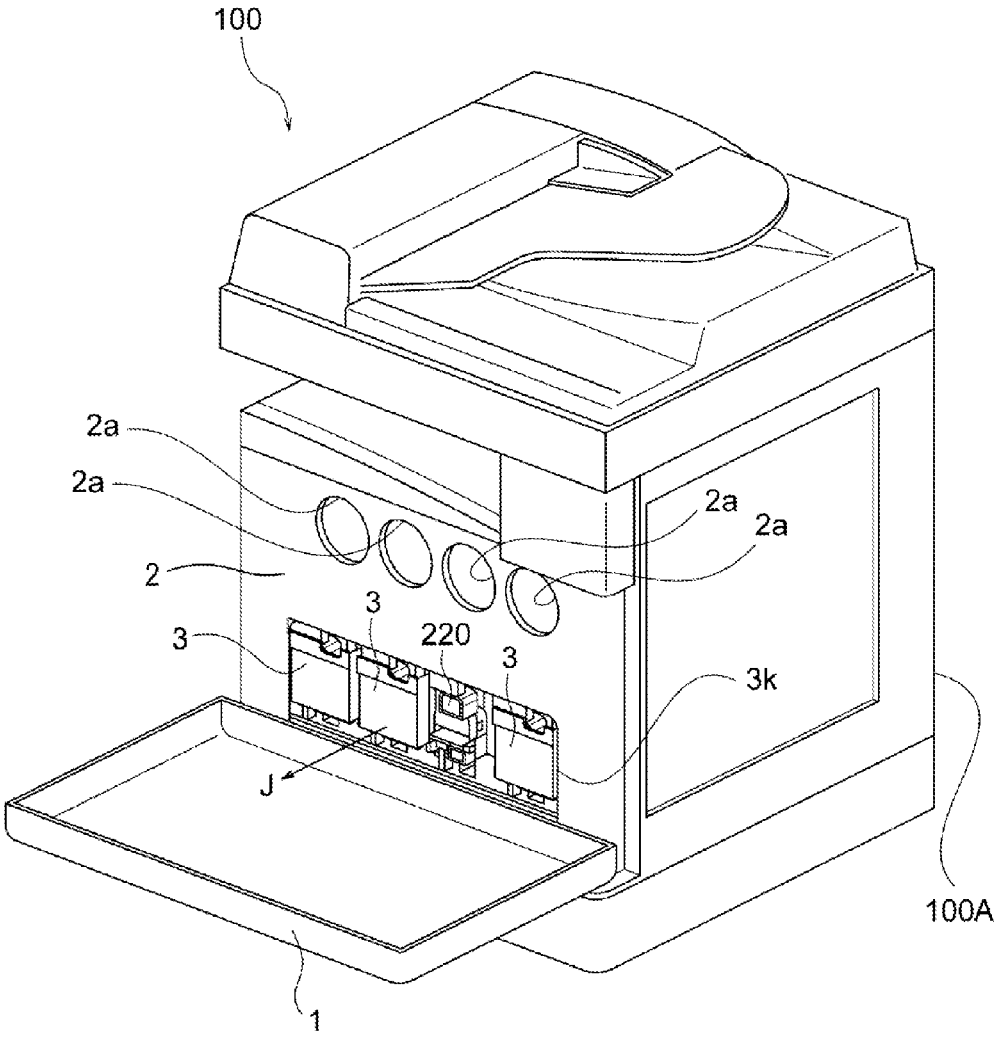
FIG. 1 is a perspective view of an image forming apparatus in a state a front cover is opened.

FIG. 1 is a perspective view of an image forming apparatus 100 in a state where a front cover 1 is opened. The image forming apparatus 100 includes an apparatus body 100A and the front cover 1 which is rotatably attached with respect to the apparatus body 100A. When a user opens the front cover 1 in a direction of an arrow J, an inner cover 2 will appear on the inside. Openings 2*a* are formed in parallel with each other on the inner cover 2. Four cartridges 221 (see FIG. 2) are inserted into the openings 2*a* in parallel with each other in a horizontal direction. In addition, an opening 3*k* is formed on the inner cover 2. A developing unit 220 as a development device is inserted into the opening 3*k*. A small cover 3 is attached to the developing unit 220. FIG. 1 illustrates a state where the small cover 3 is removed from one developing unit 220.

Figure 2:
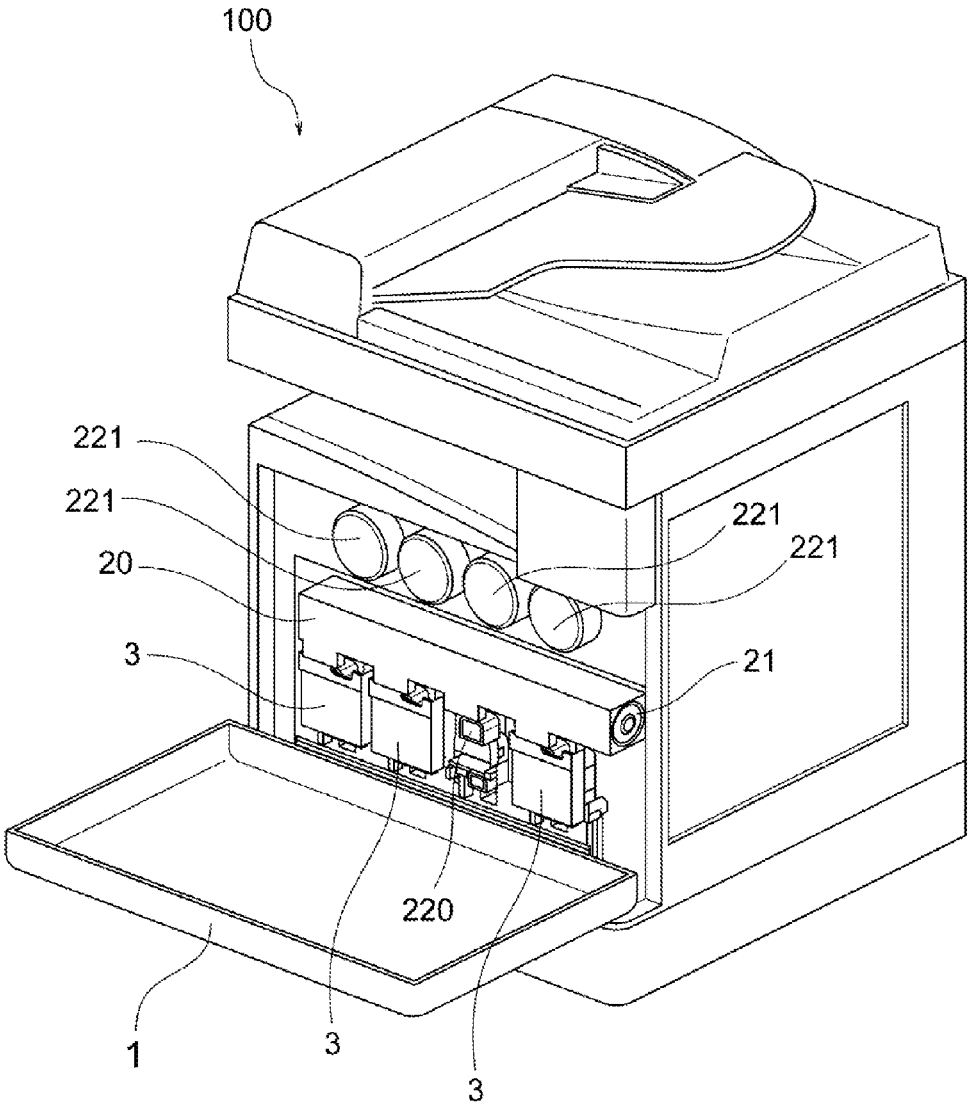
FIG. 2 is a perspective view of the image forming apparatus in a state where an inner cover of FIG. 1 is transparent.

FIG. 2 is a perspective view of the image forming apparatus 100 in a state where the inner cover 2 of FIG. 1 is transparent. Inside the apparatus body 100A, a duct 20 is disposed above the developing unit 220, and the cartridge 221 is disposed above the duct 20. A fan 21 as an "airflow generating device" is attached to the duct 20 to generate the airflow. The duct 20 induces the airflow, which is generated by the fan 21, into the inside of the apparatus body 100A. The developing unit 220 extends in a direction perpendicular to an extending direction of the duct 20. The above-described small cover 3 as a "door member" faces one end in a longitudinal direction of a developer container 209 of the developing unit 220 to freely open and close the opening (opening portion) 3*k*.

Figure 3:
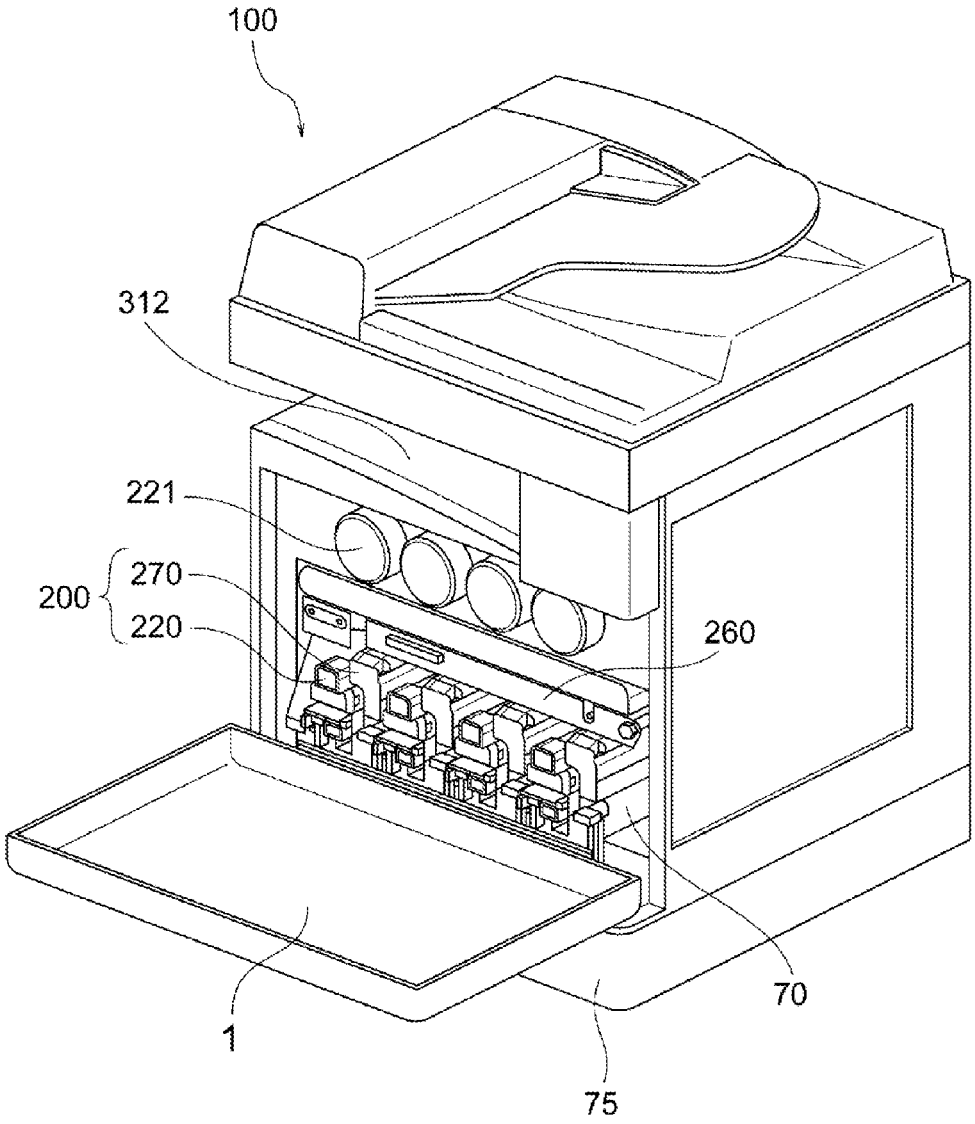
FIG. 3 is a perspective view of the image forming apparatus in a state where a small cover, an air duct, and a fan of FIG. 2 are transparent.

FIG. 3 is a perspective view of the image forming apparatus 100 in a state where the small cover 3, the duct 20, and the fan 21 of FIG. 2 are transparent. Inside the apparatus body 100A, four image forming units 200 are disposed in parallel with each other in a horizontal direction. Each of the four image forming units 200 includes a drum unit 270 and the developing unit 220 and is used to form images which are different from each other in color.

An intermediate transfer belt 260 is disposed above four image forming units 200. The intermediate transfer belt 260 is stretched by various rollers such as a secondary transfer roller, an idle roller, or a tension roller, which are not illustrated in the drawing. The secondary transfer roller is disposed along a conveying path of an image-transferred material so that a nip portion is formed between the secondary transfer roller and a roller opposite thereto.

Four cartridges 221 are disposed in parallel with each other above the intermediate transfer belt 260. Thus, the cartridge 221 is disposed above the developing unit 220, as a "replenishing portion" which replenishes the developer to the developing unit 220. A replenishing unit (not illustrated) is disposed at an inner side of the apparatus body 100A to deliver the toner supplied from the cartridge 221 to the developing unit 220.

A laser unit 70 is disposed below four image forming unit 200. In other words, the laser unit 70 as an "exposure portion" is disposed below the developing unit 220. The laser unit 70 is configured to expose a photosensitive drum 210 as an "image bearing member".

A cassette 75 is disposed below the laser unit 70. A sheet conveying path, a secondary transfer roller, and a fixing device are disposed on a right side of the apparatus body 100A. In addition, a discharge tray 312 is formed at an upper part of the apparatus body 100A.

The surface of the photosensitive drum 210 is uniformly charged by a charge roller and is formed with an electrostatic image through the exposure by the laser unit 70 to form a developer image using the developing unit 220. Then the developer image is transferred onto a recording material at the nip portion between the intermediate transfer belt 260 and the secondary transfer roller. Meanwhile, the recording material accommodated in the cassette 75 is discharged to the discharge tray 312 through the conveying roller, the nip portion between the intermediate transfer belt 260 and the secondary transfer roller, and the fixing device.

Figure 4:
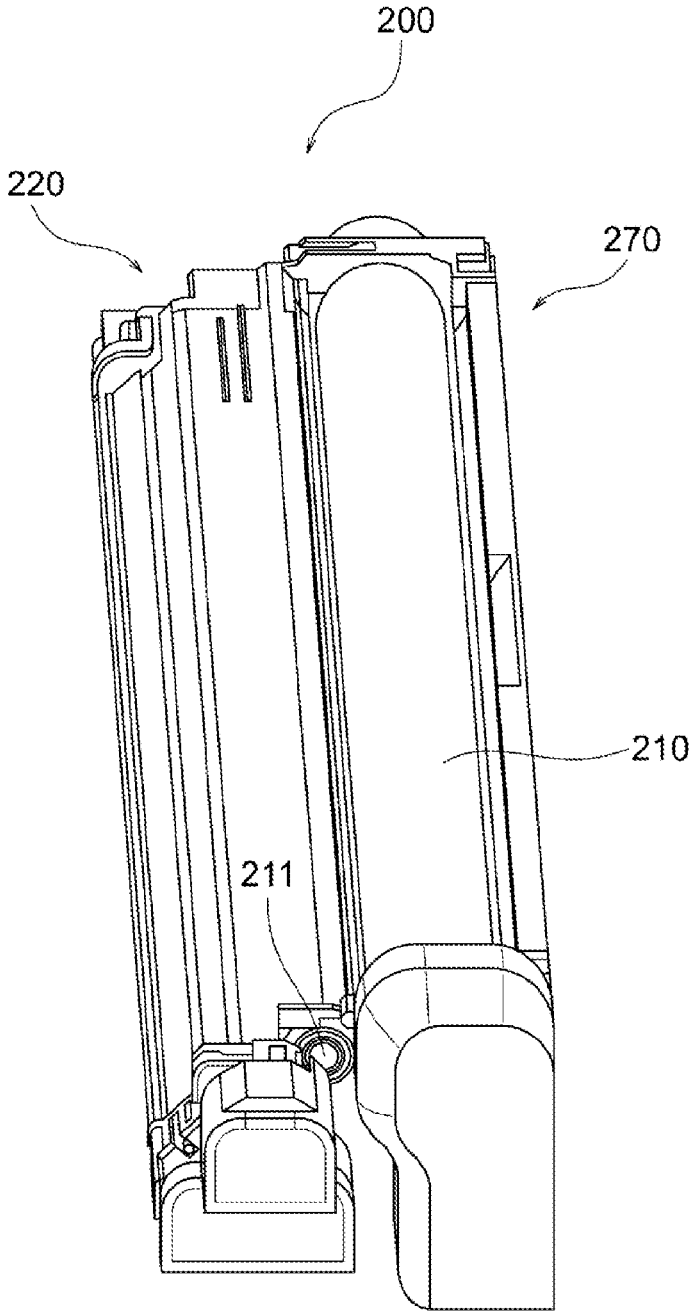
FIG. 4 is a perspective view of an image forming unit.

FIG. 4 is a perspective view of the image forming unit 200. In the image forming apparatus 100, the image forming unit 200 is freely detachable (detachably attachable) to the apparatus body 100A. As illustrated in FIG. 4, the image forming unit 200 includes the developing unit 220 and the drum unit 270. The developing unit 220 has a developing roller 211, and the drum unit 270 has the photosensitive drum 210. The developing unit 220 as a "development device" develops the electrostatic image on the surface of the photosensitive drum 210 with the developer.

Figure 5:
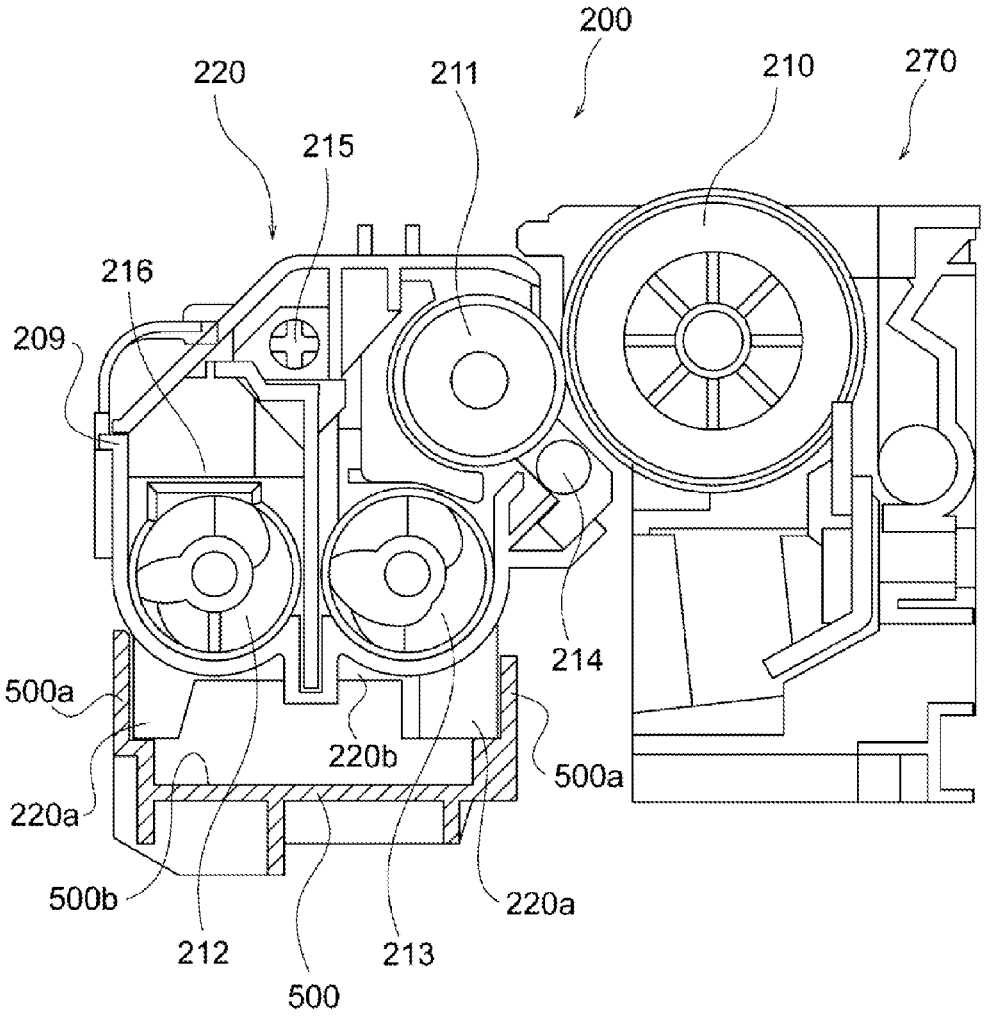
FIG. 5 is cross-sectional view of the image forming unit.

FIG. 5 is a cross-sectional view of the image forming unit 200. As illustrated in FIG. 5, the image forming unit 200 includes the developing unit 220 and the drum unit 270. The developing unit 220 employs a system for using two-component developer and has a developer container 209. Inside the developer container 209, the developing roller 211 is disposed at an upper part and conveying screws 212 and 213 are disposed at a lower part. A regulating member 214 faces the surface of the developing roller 211 to regulate the amount of coating of the toner on the surface of the developing roller 211. The developer is filled up to a position of a developer-surface level 216 inside the developer container 209.

The replenished toner circulates inside the developer container 209 by the conveying screws 212 and 213 and is then conveyed to the developing roller 211. The developing roller 211 and the photosensitive drum 210 are disposed in proximity to each other so as to have a predetermined distance.

Figure 6A:
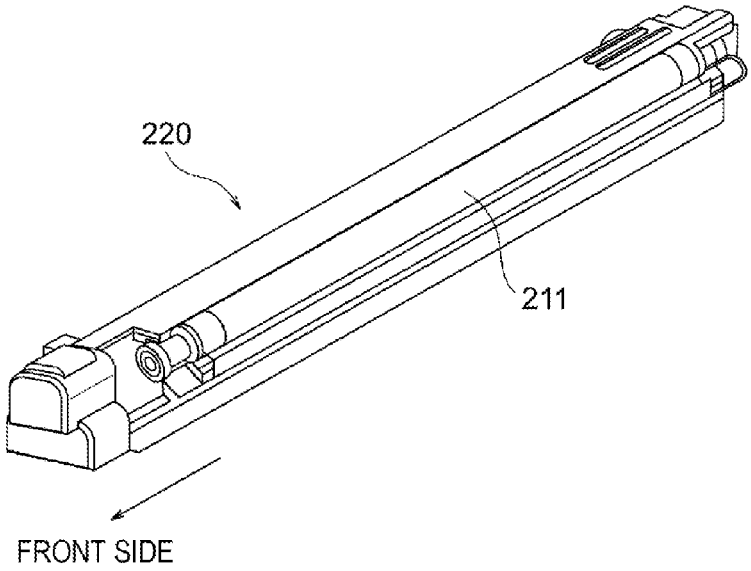
FIG. 6A is a perspective view of a developing unit as viewed from a front side.

FIG. 6A is a perspective view of the developing unit 220 as viewed from a front side. As illustrated in FIG. 6A, the developing unit 220 has the developing roller 211.

Figure 6B:
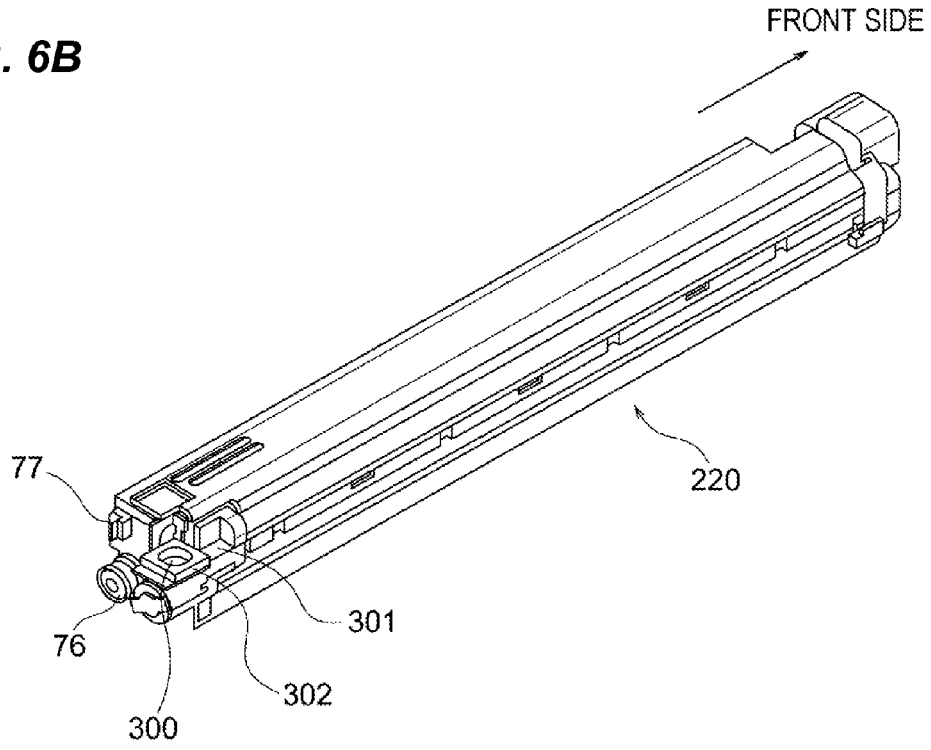
FIG. 6B is a perspective view of the developing unit as viewed from a rear side.

FIG. 6B is a perspective view of the developing unit 220 as viewed from a rear side. As illustrated in FIG. 6B, a replenishing port 300 for receiving the toner, a replenishing shutter 301, and a seal 302 are disposed immediately above the conveying screw 212 at the rear of the developing unit 220. The developing unit 220 is considered as a unit which can be detachably attachable to the apparatus body 100A and be replaced in the apparatus body 100A. When the developing unit 220 is detached from the apparatus body 100A, the replenishing shutter 301 shields the replenishing port 300 such that the developer inside the developing unit 220 is sealed.

Further, the developing unit 220 immediately after shipment is configured such that a gap inside the developing unit is completely covered by a film member (not illustrated) to completely seal the developer and a winding shaft 215 winds up the film member as soon as a driving input is received.

In addition, the developer inside the developing unit is sealed by the seal 302 as described above so as to prevent it from leaking into the outside of the developing unit 220 even during the driving input, but the developer attached to the seal may be scratched off by an opening/closing operation of the replenishing shutter 301, and thus being dropped or scattered into the inside of the apparatus.

A driving coupling 76 is provided beside the replenishing port 300 to drive the developing roller 211 and the conveying screws 212 and 213. The driving coupling 76 receives the driving input from a driving source inside the apparatus to rotate and drive the developing roller 211. Further, a high-voltage contact 77 is provided immediately above the driving coupling 76 so as to add an electrical polarity to the developer.

As described above, function members such as the shutters, the driving coupling 76, or the high-voltage contact 77 are collectively disposed at the rear of the developing unit 220 to receive various types of input from the apparatus body 100A, and thus it is difficult to dispose other functions at the rear of the developing unit 220. Further, for example, a space can be created by bringing the high-voltage contact 77 to the front of the developing unit 220, but it is necessary to pull a high-voltage line from the inside of the apparatus body 100A to the front, resulting in causing problems such as unit arrangement or cost increase.

In the above configuration, when the developing unit 220 receives the driving input, the developing roller 211, the conveying screws 212 and 213, and the winding shaft 215 (see FIG. 5) receive a rotation driving.

Figure 7:
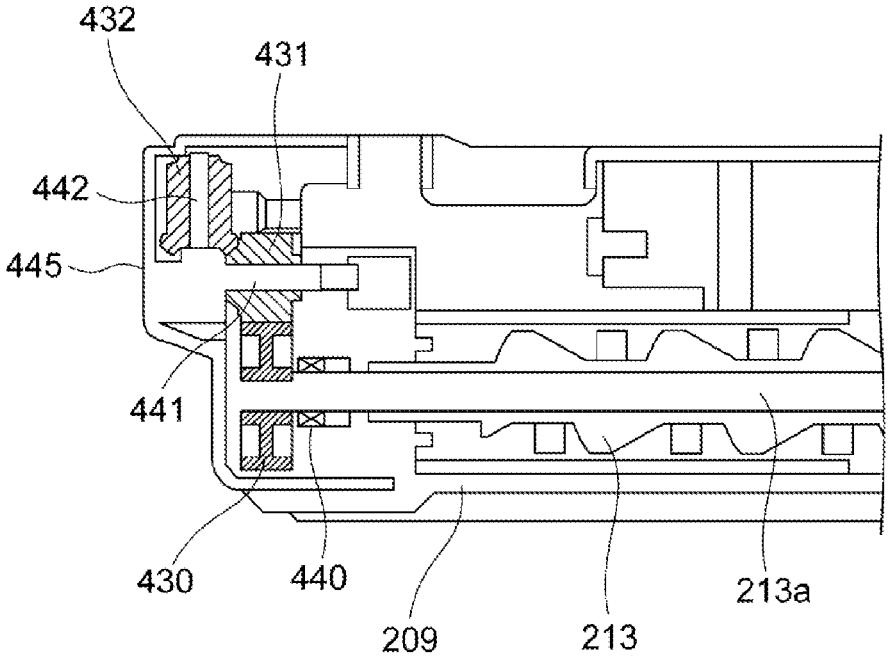
FIG. 7 is a cross-sectional view of the developing unit at the front in a longitudinal direction.

FIG. 7 is a cross-sectional view of the developing unit 220 at the front in a longitudinal direction. In FIG. 7, a gear for driving the conveying screws 212 and 213 and the winding shaft 215 is illustrated. The developing unit 220 has the conveying screws 212 and 213 as a "conveyance member" which conveys the developer. The conveying screw 213 has a penetrating shaft 213*a*. The penetrating shaft 213*a* is axially supported by a bearing 440. A gear 430 is fittingly engaged with an end of the penetrating shaft 213*a*. The driving force of the gear 430 is transmitted to gears 431 and 432.

The gear 432 drives to rotate the winding shaft 215 (further, the developing roller 211 directly receives the driving force from the driving coupling 76) (see FIG. 6). The bearing 440 for axially supporting the conveying screw 213 and shafts 441 and 442 for supporting the gears are supported and covered by a driving support plate 445 and the developer container 209.

The gear 430, the shaft 441, the gear 431, the shaft 442, and the gear 432 as a "driving transmitting member" are members which transmit the driving force to the conveying screws 212 and 213. The driving support plate 445 as a "cover member" is a member which covers the gear 430, the shaft 441, the gear 431, the shaft 442, and the gear 432. The developer container 209 holds the conveying screws 212 and 213, the gear 430, the shaft 441, the gear 431, the shaft 442, the gear 432, and the driving support plate 445.

When the conveying screws 212 and 213 rotate, the developer circulates inside the developer container 209 while being agitated. At this time, since a composition of the developer can contain iron, driving energy caused by the agitation is converted into heat in the form of a self-heating of the developer. That is, when the driving input is transmitted to the conveying screws 212 and 213, the developer stores heat.

Accordingly, the higher the agitating speed and the conveying speed, the more heat storage quantity of the developer increases.

In addition, friction heat is generated by a sliding friction in the bearing 440 and the like for axially supporting the conveying screws 212 and 213 and the shafts 441 and 442 for supporting the gears, and such heat is propagated to the developer container 209 and thus is further applied to the developer.

As described above, the developer is weak to the heat. As the heat is applied to the developer, quality characteristics of the image are reduced. For example, variation in the amount of developer coating, change in electrical polarity, and damage of the developer occur on the surface of the developing roller 211, resulting in reducing the image quality such as density unevenness and low density of the image formed by the image forming apparatus 100. Therefore, a structure for cooling the developer is essential for the image forming apparatus 100, and a future image forming apparatus strongly requires cooling performance which is more improved.

Figure 8A:
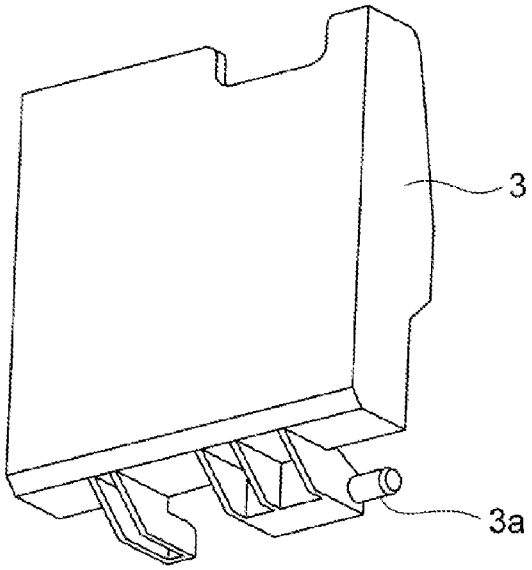
FIG. 8A is a perspective view of the small cover.
Figure 8B:
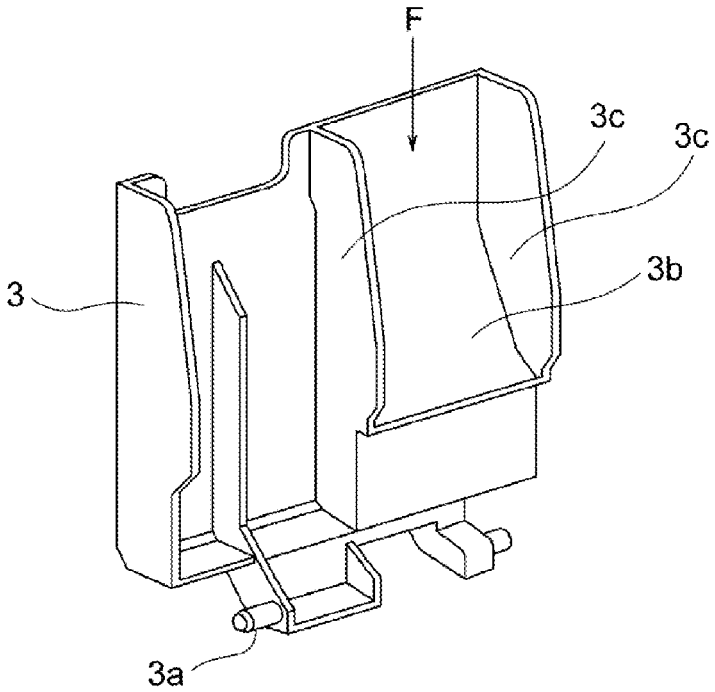
FIG. 8B is a perspective view of a back side of the small cover.

FIG. 8A is a perspective view of a surface of the small cover 3, and FIG. 8B is a perspective view of a back side of the small cover 3. As illustrated in FIGS. 8A and 8B, a rotating shaft 3*a* is fixed to the bottom of the small cover 3. The rotating shaft 3*a* is rotatably supported on the apparatus body 100A. When mounting the developing unit 220 to the apparatus body 100A, a user sequentially opens the front cover 1 and the small cover 3. By this, an insertion space of the developing unit 220, which is partitioned in the apparatus body 100A, is exposed to the outside. The user pushes the developing unit 220 up to a predetermined position while guiding it to a developing tray 500 fixed in the apparatus body 100A. Thus, the developing unit 220 is positioned inside the apparatus body 100A.

In addition, as illustrated in FIG. 8B, two (a pair) ribs (first walls) (rib members) 3*c* are protruded along a vertical direction. An inclined surface 3*b* as an "inclined portion" is formed between the ribs 3*c* to guide airflow with a first flow path J1 to a second flow path J2. The small cover 3 illustrated in FIG. 8B looks like an approximate U-shape by the inclined surface 3*b* and the rib 3*c* when viewed in plane from above.

Figure 9:
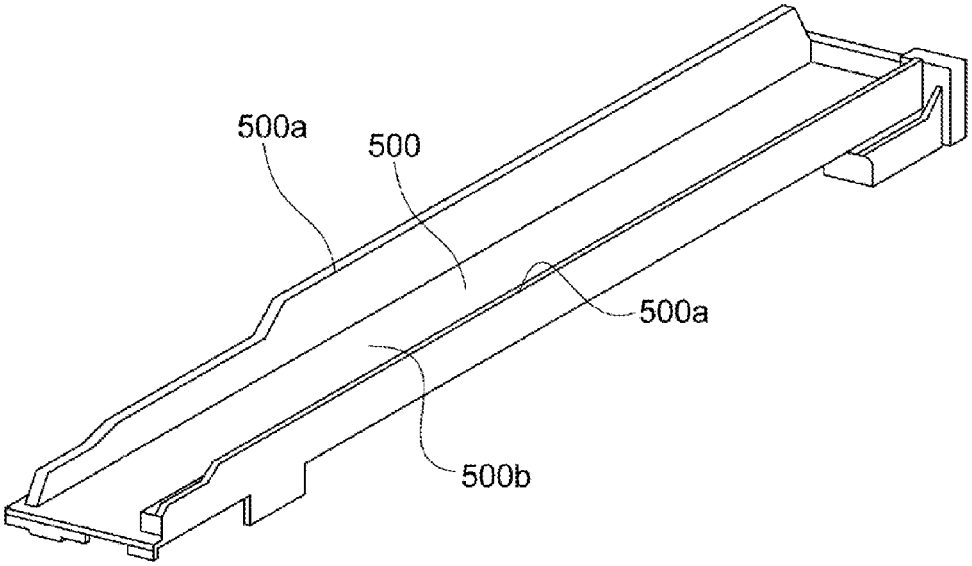
FIG. 9 is a perspective view of a developing tray.

FIG. 9 is a perspective view of the developing tray 500. The developing tray 500 as a "support member" illustrated in FIG. 9 supports a lower surface of the developer container 209 of the developing unit 220 along the longitudinal direction of the developer container 209. The developing tray 500 is a member which guides the developing unit 220 while supporting the developing unit 220. The developing tray 500 includes two ribs 500*a* which protrudes upward at both ends in the width direction. Accordingly, the developing tray 500 is formed in a section of an upward U-shape when viewed in a cross section. The developing tray 500 is adapted to guide insertion/extraction of the developing unit 220 by two ribs 500*a* and to receive the dropping and scattering toner by a plane portion 500*b* during the insertion/extraction of the developing unit 220.

Figure 10:
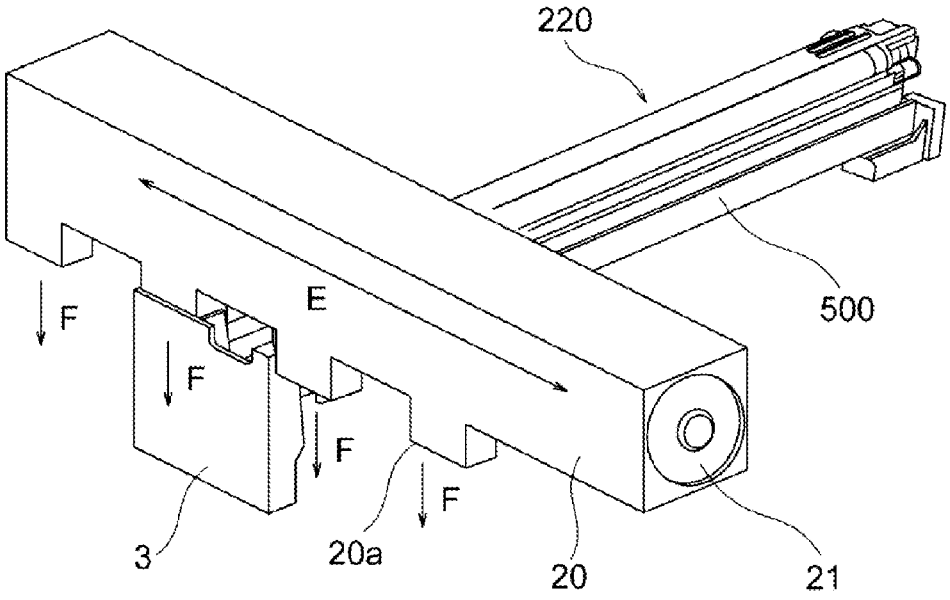
FIG. 10 is a perspective view illustrating the configuration of the duct, the fan, the small cover, the developing unit, and the developing tray.

FIG. 10 is a perspective view illustrating the configuration of the duct 20, the fan 21, the small cover 3, the developing unit 220, and the developing tray 500. After the developing unit 220 is mounted in the apparatus body 100A, the small cover 3 is closed, and the cooling mechanism of the developer is completed by the fan 21, the duct 20, the small cover 3, the developing tray 500, and the developing unit 220.

First, the fan 21 rotates to suck the air into the inside of the duct 20. The air flows along the direction of an arrow E in the inside of the duct 20. The inside of the duct 20 is formed in a smooth tubular shape and the airflow is formed along the duct 20 without causing nearly loss.

A plurality of opening portions 20*a* to be opened downward is formed at the duct 20, and the opening portion 20*a* corresponds to the opening (place surrounded by the rib 3*c*, the inclined surface 3*b*, and the driving support plate 445) formed on the small cover 3 and the driving support plate 445. The air is branched by changing the flow to the direction of an arrow F through the opening portion 20*a*.

Figure 11:
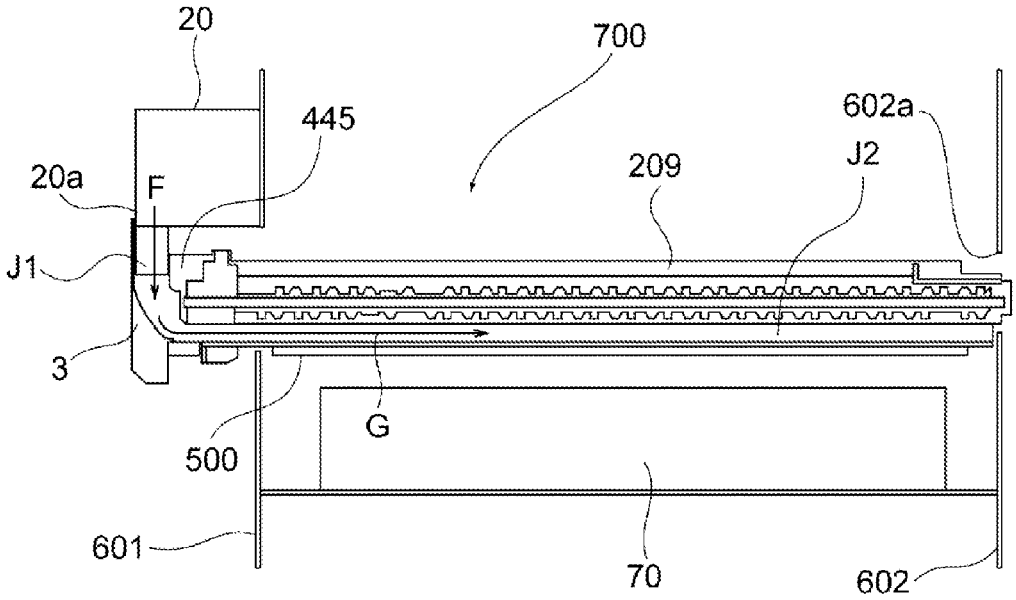
FIG. 11 is a cross-sectional view of a cooling mechanism.

FIG. 11 is a cross-sectional view of a cooling mechanism 700. As illustrated in FIG. 11, the cooling mechanism 700 is mainly formed by the small cover 3, the developing tray 500, and the developer container 209 at a downstream side of the opening portion 20*a*. The opening portion 20*a* of the duct 20 and the driving support plate 445 of the developer container 209 and the small cover 3 ensure a predetermined amount of overlap, and the opening portion 20*a* of the duct 20 is communicated with the driving support plate 445 of the developer container 209 and the small cover 3. For this reason, the first flow path J1 is mutually overlapped therewith. The first flow path J1 of a substantially tubular shape, which is connected to the duct 20, is formed between the driving support plate 445 of the developer container 209 and the small cover 3 to pass the airflow generated by the fan 21. The second flow path J2 of a substantially tubular shape, which is connected to the first flow path J1, is formed between the developing tray 500 and the developer container 209 to pass the airflow generated by the fan 21. The airflow generated by the fan 21 passes through the first flow path J1 and the second flow path J2. The airflow flows from the front part toward the rear part of the apparatus body 100A by the fan 21.

In addition, an airflow path of a tubular shape is formed by the driving support plate 445 of the developer container 209 and the inclined surface 3*b* of the small cover 3 at a lower part of the cooling mechanism. Since the airflow path is formed in a tubular shape of a small gap, the minimum airflow is leaked from the gap and the loss of air volume is small.

When the air flows in the direction of an arrow F, the shaft, the bearing and the developer container, which are covered by the driving support plate 445, are cooled.

The air flows in the direction of an arrow G by the inclined surface 3*b* of the small cover 3. The small cover 3 faces the driving support plate 445 of each developing unit 220. The inclined surface 3*b* of the small cover 3 is smoothly formed such that the air volume of the airflow is maximized and the loss of the airflow is minimized together with the driving support plate 445. Thus, the loss of the air volume is minimized even in a case of changing the direction of the airflow.

When the air flows in the direction of the arrow G, the air flows into a space formed by the developer container 209 and the developing tray 500 to be exhausted to the back from an opening hole 602*a* which is formed at a rear-side plate 602. Moreover, as illustrated in FIG. 5, the developer container 209 includes two (a pair) legs 220*a*, 220*a* (second walls) (rib members) formed downward at the bottom. The leg 220*a* is formed along the second flow path J2 (see FIG. 11). The developer container 209 is formed in a downward U-shape by a bottom 220*b* thereof and the legs 220*a* and 220*a* described above. In addition, the developing tray 500 is formed in an upward U-shape by the plane portion 500*b* and the ribs 500*a* and 500*a*.

The legs 220*a* and 220*a* of the developer container 209 are disposed so as to be overlapped with the ribs 500*a* and 500*a* of the developing tray 500 in the vertical direction, and a state similar to a closed space is ensured between the developer container 209 and the developing tray 500. That is, the pair of legs 220*a* are provided on the developing tray 500 and are formed along the second flow path J2, and lateral surfaces thereof face those of the pair of ribs (rib members) 500*a* provided in the developing tray 500. For this reason, the air can flow along the bottom of the developer container 209 while keeping the small loss of the air volume. As a result, as the air flows in the direction of the arrow G, the bottom of the developer container 209 having the maximum area, which comes in contact with the developer, is cooled.

According to the configuration of the embodiment, the air is sucked in the duct 20 by the fan 21 and is introduced into the space between the small cover 3 or the developing tray 500 and the developing unit 220 to efficiently cool the developer inside the developing unit 220. Then the air evacuates to the rear-side plate 602 of the apparatus body 100A.

In addition, a space sandwiched between a front-side plate 601 and the rear-side plate 602 is formed immediately below the developing tray 500, and the laser unit 70 is formed in this space. The laser unit 70 is separated from the space, in which the air flows, by the developing tray 500. Accordingly, dropping and scattering developer is received by the developing tray 500 and is exhausted to the back of the apparatus body 100A by the air flow. Consequently, the developer is not diffused at the inside of the apparatus body 100A or the front of apparatus body 100A, which is directed toward the user, and is not adhered onto the laser unit 70.

When inserting and extracting the developing unit 220 into/from the apparatus body 100A, the user is accessible to the developing unit 220 only by opening the small cover 3 corresponding to each the developing unit 220, and thus insertion/extraction properties and detachability of the developing unit 220 are not impaired.

According to the configuration of the embodiment, it is possible to cool the developing unit 220 by avoiding the sacrifice of the arrangement or detachability of the developing unit 220 inside the apparatus body 100A while suppressing the contamination of the inside of the apparatus body 100A due to the dropping or scattering of the developer. For details, an airflow duct is formed by the developing unit 220, the small cover 3, and the developing tray 500 such that cooling air passes through a space between the small cover 3 and the developing unit 220 and a space between the developing tray 500 and the developing unit 220. Consequently, the lateral surfaces and the lower surface of the developing unit 220 are efficiently cooled, the detachability of the developing unit 220 is not impaired, and the scattering of the toner is suppressed inside the apparatus body 100A.

Moreover, the invention may not be limited to the configuration of the embodiment. For example, the fan 21 is disposed at the right end on the near side of the front-side plate 601, but may be disposed between the front-side plate 601 and the rear-side plate 602 according to the arrangement of the duct 20. As the arrangement advantageous to the dropping and scattering of the developer, the replenishing unit is arranged at the rear of the apparatus body 100A, but may be configured to replenish the developer to the developing unit 220 from the front of the apparatus body 100A. Like the configuration of the embodiment, however, as the developing tray 500 is provided, the scattering of the developer is suppressed to the minimum even in the inside of the apparatus body 100A.

Further, the driving coupling 76 as an "input member" to input the driving force to the gear 430, the shaft 441, the gear 431, the shaft 442, and the gear 432 may be configured in such a manner that a part is disposed at the rear of the apparatus body 100A and the other part is disposed at the front of the apparatus body 100A.

According to the invention, it is possible to cool the developing unit by avoiding the sacrifice of the arrangement or detachability of the developing unit inside the apparatus body while suppressing the contamination of the inside of the apparatus body due to the dropping or scattering of the developer.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2013-010476, filed Jan. 23, 2013, which is hereby incorporated by reference herein in its entirety.

What is claimed is:

1. An image forming apparatus comprising:

a development device which is provided so as to be detachably attachable to an apparatus body to develop an electrostatic image on a surface of an image bearing member with a developer;

an airflow generating device which generates an airflow;

a support member which supports a lower surface of the development device along a longitudinal direction of the development device;

an inner door which is openable and closable so as to detachably attach the development device;

an outer door which covers the inner door;

a first duct portion which is formed by the inner door and a lateral surface of the development device, to form an airflow path to cool the developing device, wherein the first duct portion guides the airflow generated by the airflow generating device along the lateral surface in a vertical direction; and a second duct portion which forms a path for the airflow that passes through the first duct portion, the second duct portion being formed by the support member and a bottom of the development device and forms the airflow path to cool the development device, wherein the second duct portion guides the airflow generated by the airflow generating device along a longitudinal direction of the development device.

2. The image forming apparatus according to claim 1, wherein the support member includes a pair of walls which form lateral surfaces of the second duct portion.

3. The image forming apparatus according to claim 2, wherein the bottom of the development device is provided with a pair of legs which form the lateral surfaces of the second duct portion.

4. The image forming apparatus according to claim 3, wherein the pair of walls and the pair of legs overlap with each other in a vertical direction.

5. The image forming apparatus according to claim 3, wherein a bottom surface of the support member has a first surface which supports the pair of legs provided at the development device, and a second surface which forms a bottom portion of the second duct portion and is provided at a lower position than the first surface.

6. The image forming apparatus according to claim 1, wherein the inner door is provided with a pair of rib portions which protrude toward a front side of the development device from an inner side of the inner door, and the first duct portion is formed by the rib portions.

7. The image forming apparatus according to claim 1, further comprising an inclined portion provided on the inner door to guide the airflow in the vertical direction in the first duct portion toward the second duct portion.

8. The image forming apparatus according to claim 1, further comprising a third duct portion which guides the airflow generated by the airflow generating device toward the first duct portion, with the first duct portion and the third duct portion connected to each other so as to overlap with each other in the airflow direction.

9. The image forming apparatus according to claim 1, further comprising an exposure apparatus which is located below the support member and exposes the image bearing member.

10. The image forming apparatus according to claim 1, further comprising a drive force transmission member which is provided with the development device at a side of the inner door in the longitudinal direction of the development device, and transmits a drive force to the development device.

11. The image forming apparatus according to claim 1, further comprising a second development device which is provided so as to be detachably attachable to an apparatus body to develop an electrostatic image on a surface of a second image bearing member with a developer; and a second inner door which is openable and closable so as to detachably attach the second development device;

wherein the second inner door is covered by the outer door.

* * * * *